United States Patent [19]

DeLue et al.

[11] Patent Number: 4,584,070

[45] Date of Patent: Apr. 22, 1986

[54] PROCESS FOR PREPARING PARA-AMINOPHENOL

[75] Inventors: Norman R. DeLue, Akron; Stanley R. Pickens, Wadsworth, both of Ohio

[73] Assignee: PPG Industries, Inc., Pittsburgh, Pa.

[21] Appl. No.: 717,619

[22] Filed: Mar. 29, 1985

[51] Int. Cl.[4] ..... C25B 3/00

[52] U.S. Cl. ..... 204/74

[58] Field of Search ..... 204/74

[56] References Cited

U.S. PATENT DOCUMENTS

| | | | |
|---|---|---|---|
| 3,338,806 | 10/1963 | Harwood | 204/74 |
| 3,475,299 | 10/1969 | Slager | 204/74 |
| 3,645,864 | 2/1972 | Lawson | 204/74 |
| 4,264,529 | 4/1981 | Dunn | 564/418 |
| 4,307,249 | 12/1981 | Derrenbacker | 204/74 |
| 4,396,474 | 8/1983 | Astruc et al. | 204/74 |
| 4,415,753 | 11/1983 | Caskey et al. | 564/418 |

OTHER PUBLICATIONS

Journal of Applied Electrochemistry, 10 (1980), 567–573.

Journal of the Electrochemical Society, 99, 289–294 (1952), Wilson et al.

I&EC Process Design and Development, 2, 72–77 (1963), Harwood et al.

*Primary Examiner*—John F. Niebling

*Attorney, Agent, or Firm*—Bruce H. Cottrell

[57] ABSTRACT

Disclosed is a method of preparing para-aminophenol by the electrolytic reduction of nitrobenzene in an acidic, aqueous reaction medium including a trialkylamine-N-oxide surfactant, such as dimethyldodecylamine-N-oxide, by electrolytic reduction at a cathode comprised of an amalgamated metal, and by electrolytic reduction under essentially anerobic or oxygen-free conditions in the catholyte.

20 Claims, No Drawings

PROCESS FOR PREPARING PARA-AMINOPHENOL

BACKGROUND OF THE INVENTION

The present invention relates to a method of producing paraaminophenol by the electrolytic reduction of nitrobenzene.

Para-aminophenol is produced commercially by the catalytic hydrogenation of para-nitrophenol or nitrobenzene. Its principal use is for the production of the analgesic, para-acetamidophenol. Precious metal catalysts, such as platinum, are required for the catalytic hydrogenation process. The recovery of these catalysts is a significant economic factor in that process.

The electrolytic conversion of nitrobenzene to para-aminophenol has been known for nearly a century. Aniline is a by-product in any process of preparing para-aminophenol from nitrobenzene. U.S. Pat. No. 3,338,806 describes a process for producing para-aminophenol by the reduction of nitrobenzene in an electrolyte of ethanol and sulfuric acid. Other possible products include azoxybenzene, azobenzene, hydrazobenzene, aniline and para-benzidine. This process also produces para-phenetidine as an undesired alcohol by-product and has the further disadvantage of recycling solvent.

U.S. Pat. No. 4,307,249 describes the catalytic production of para-aminophenol from nitrobenzene in an acidic reaction medium containing dimethylalkylamine-N-oxide as a surfactant using a platinum on carbon catalyst. However, the selectivity for para-aminophenol in that process is low, the para-aminophenol to aniline ratio being about 4 or 5 to 1.

DESCRIPTION OF THE INVENTION

An improved process of preparing para-aminophenol from nitrobenzene with a high selectivity, i.e., a high para-aminophenol to aniline ratio, has been found. The process involves the electrolytic reduction of nitrobenzene in an acidic, aqueous reaction medium including a nonionic surfactant. This process eliminates the disadvantage of solvent recycling and the economic burden of using a precious metal catalyst. The process further involves conducting the electrolytic reduction in the absence of free oxygen.

DETAILED DESCRIPTION OF THE INVENTION

In the present invention para-aminophenol is prepared by the electrolytic reduction of nitrobenzene in a single reaction vessel with a high selectivity for para-aminophenol over assorted by-products, such as aniline or azoxybenzene. The electrolytic reduction is carried out in an acidic, aqueous reaction medium containing a non-ionic surfactant, e.g., a trialkylamine-N-oxide. The preparation of para-aminophenol in accordance with the present process is conducted in a cell having an anolyte chamber with an anode therein, a catholyte chamber with a cathode therein and an ion exchange membrane separating the anolyte and catholyte chambers.

The cathode should have a reasonably high hydrogen overpotential and can comprise a transition metal, a Group IIIA metal, such as aluminum, gallium, indium, or thallium, a Group IVA metal, such as germanium, tin or lead, an amalgamated metal from the above group, or a material such as graphite or vitreous carbon. Suitable materials for the cathode include, for example, graphite, titanium, copper, zinc-coated copper, nickel, lead, gold and a nickel-copper alloy, e.g., Monel ®. The preferred cathode is an amalgamated transition metal, for example, amalgamated copper, amalgamated zinc, amalgamated nickel, or an amalgamated nickel-copper alloy. An amalgamated transition metal cathode can be prepared by immersing the selected transition metal alternately in dilute nitric acid and then elemental mercury or by in situ plating from a solution containing mercuric ions. An amalgamated copper cathode has been found to be particularly effective in the practice of this invention. The cathode can be in the form of a perforated sheet or plate, a mesh, an expanded mesh or a screen.

The anode can comprise, for example, platinum-coated titanium, graphite, or lead dioxide. A platinum-coated titanium mesh has been found to be the anode material of choice, but any anode material capable of withstanding the acidic environment of the anolyte may be used. The anode can be a perforated sheet or plate, a mesh, an expanded mesh or a screen.

The ion exchange membrane should be capable of passing hydrogen ions from the anolyte to the catholyte. The ion exchange membrane is a cation exchange membrane. The ion exchange groups upon the membrane can be, for example, carboxylic or sulfonic acid groups, and preferably are sulfonic acid groups. The membrane backbone can be made of fluorocarbon copolymers, such as the backbone in the Nafion ® membranes available from E. I. DuPont de Nemours and Company, divinyl benzene-styrene copolymers, or polyethylene propylene radiation grafted with styrene groups. The preferred ion exchange membranes are the Nafion ® type fluorocarbon membranes.

The reaction medium, i.e., the catholyte, for the electrolytic reduction of the nitrobenzene is an acidic, aqueous medium. The reaction medium includes a strong acid with a non-nucleophilic anion, e.g., sulfuric acid, fluoroboric acid, perchloric acid, and hexafluorophosphoric acid. Preferably, the reaction medium includes sulfuric acid. The anolyte is also an acidic, aqueous medium selected from among acids such as sulfuric acid, sulfurous acid, fluoroboric acid, perchloric acid and hexafluorophosphoric acid.

In one embodiment of the invention, the reaction is performed under anerobic conditions, i.e., in the substantial absence of free oxygen. By maintaining the catholyte essentially oxygen free during the electrolytic reduction of the nitrobenzene, the production of azoxybenzene has been significantly reduced. Oxygen can react with phenylhydroxylamine to form nitrosobenzene. The nitrosobenzene can undergo a condensation reaction with the phenylhydroxylamine to form azoxybenzene before the phenylhydroxylamine can rearrange to para-aminophenol.

Although nitrosobenzene is formed during the electrolytic reduction, this nitrosobenzene is formed at the cathode and further reduction to phenylhydroxylamine can readily occur while the nitrosobenzene is at the cathode. In contrast, the oxygen and phenylhydroxylamine reaction can happen throughout the catholyte solution and the resultant nitrosobenzene may not be further reduced to phenylhydroxylamine at the cathode before the azoxybenzene-forming condensation reaction. It has been found that by carefully excluding free oxygen from the reaction, the production of azoxybenzene can be reduced to under 1 part per million. Since azoxybenzene can be further reduced to azobenzene and easily converted within an electrolytic cell to parabenzidene, a carcinogen, the reduction of the selectivity of the reaction for azoxybenzene is advantageous.

A three-compartment cell can be utilized to perform the reaction under anerobic conditions. This cell can contain a third compartment between the anolyte compartment and the catholyte compartment of the electrolytic cell. It is desired to maintain the catholyte under the anerobic conditions. During the electrolytic reaction, oxygen can be generated at the anode within the anolyte compartment. By providing an intermediate compartment, the amount of oxygen able to permeate through to the catholyte compartment can be reduced or eliminated. The third compartment is separated by a cation exchange membrane from both the anolyte and catholyte compartments. An inert gas can be bubbled through the third compartment during the cell operation as a flushing or purging means. For example, the inert gas can be argon or nitrogen.

The anerobic conditions can be further achieved by using freshly boiled water and sulfuric acid within the compartments, particularly the catholyte compartment, to remove dissolved oxygen. The liquids including the nitrobenzene and surfactant solution can be purged or degassed by several cycles of exposure to vacuum and then nitrogen to obtain essentially oxygen-free, anerobic conditions within the catholyte compartment.

Other methods of preventing oxygen from reaching the catholyte compartment are readily known to those skilled in the art. For example, the electrolytic cell reaction can be conducted in a glove bag or dry box continuously flushed with an inert gas, or the materials can be added by a syringe through a septum into the catholyte compartment.

The catholyte further includes a non-ionic surfactant. The surfactant is present in amounts sufficient to provide a catholyte in the form of a stable, homogenous emulsion, i.e., an emulsion that does not immediately separate into layers upon standing. The non-ionic surfactant can be an aliphatic amine oxide, in particular, a trialkylamine-N-oxide of the formula $$R_1R_2R_3NO$$

wherein $R_1$ is a $C_4$–$C_{30}$ alkyl group and both $R_2$ and $R_3$ are $C_1$–$C_2$ alkyl groups. When employing the trialkylamine-N-oxide as the surfactant, only the single long carbon chain ($R_l$) is needed in the surfactant molecule. The additional alkyl groups ($R_2$ and $R_3$) are preferably short carbon chains, such as methyl or ethyl. Particularly suitable trialkylamine-N-oxides are those wherein the alkyl group, $R_1$, contains from 4 to 30 carbon atoms, preferably 10 to 16 carbon atoms and most preferably 12 to 14 carbon atoms and both $R_2$ and $R_3$ contain only one carbon atom. Especially suitable dimethylalkylamine-N-oxide surfactants include: dimethyldodecylamine-N-oxide, dimethyltetradecylamine-N-oxide and dimethyltridecylamine-N-oxide. The surfactant can also comprise mixtures of the individual surfactants. The amount of surfactant needed to obtain the stable homogenous emulsion is typically from about 0.03 to 1.5 percent by weight of the total weight of catholyte.

The catholyte includes the nitrobenzene reactant. The nitrobenzene is present in an amount capable of being effectively emulsified within the catholyte, an amount about 5 to 20 percent by weight of the total weight of the catholyte.

During electrolysis, the catholyte is stirred to improve the mixing within the solution. Any convenient means of stirring or mixing can be employed, for example, a magnetic stir bar or an overhead stirrer may be used to promote mixing.

The electrolytic reduction of the nitrobenzene can be conducted at a current density of from 0.2 to 60 amperes per square decimeter [A/dm$^2$], preferably from 15 to 25 A/dm$^2$ and most preferably at about 20 A/dm$^2$. A particularly suitable trade-off between current density and current efficiency is found at about 20 A/dm$^2$. The acidic aqueous catholyte includes distilled water, the strong acid (e.g., sulfuric acid), the surfactant, and the reactant, nitrobenzene. The anolyte comprises the strong acid. The acidity of these electrolytes (the catholyte, the anolyte and the electrolyte within the third compartment, when present) can be from 1 to 10 Molar (M) in sulfuric acid, preferably about 1.5 to 3 M. The temperature of the catholyte and anolyte system is maintained between 30° and 120° degrees centigrade (°C.), preferably between 80° to 100° C.

By the present process, para-aminophenol can be prepared with a high selectivity ratio between para-aminophenol and the by-product aniline, and production of other by-products, such as azoxybenzene can be minimized. For example, the ratio of para-aminophenol to aniline in this process ranges from 7–25 to 1. Selectivities for para-aminophenol in that range are much improved over the catalytic hydrogenation processes involving use of surfactants. The reduction in production of other products can simplify separation of the para-aminophenol reaction product.

In the practice of the invention a solution of 2 M sulfuric acid is entered into the anolyte and catholyte compartments of an electrolytic cell and heated to a temperature of 90° C. No alcohol, such as ethanol, is introduced into the cell. Nitrobenzene is added to the catholyte compartment in an amount of about 7 percent by weight of nitrobenzene in the catholyte. An aqueous solution of a surfactant (such as dimethyldodecylamine-N-oxide) is added to the catholyte in an amount of about 0.10 percent by weight. Current is passed through the cell. The nitrobenzene in the catholyte is reduced at the cathode to phenylhydroxylamine which rearranges to give para-aminophenol.

The invention is further illustrated by the following examples.

EXAMPLE 1

A cell was constructed having a copper screen cathode with 0.011 inch diameter wires woven at 30 per inch, and a platinized titanium flattened expanded metal mesh anode. A cation exchange membrane separated the anode compartment and the cathode compartment. The membrane was a Nafion® 324 membrane available from E. I. DuPont de Nemours and Company. The anolyte was a sulfuric acid solution of 1.7 molarity. The catholyte included by weight about 68% distilled water, about 24% sulfuric acid, about 0.12% dimethyldodecylamine-N-oxide [added as a 30% aqueous solution] and about 7% nitrobenzene (26.8 grams). The catholyte was purged with nitrogen prior to electrolysis. The cell was heated to 90° C. and electrolysis was started. Cell voltage was maintained at 2.7 volts throughout the run. The current was monitored with the average current density being 4.6 A/dm$^2$. The temperature remained at 90° C. The catholyte was stirred during electrolysis by means of a magnetic stirrer. 70,000 coulombs were passed through the cell. At the end of the run the catholyte mixture weighed 398.8 g. The mixture was analyzed by high pressure liquid chromatography as containing 3.52% para-aminophenol and 0.408 percent aniline for a para-aminophenol to aniline molar ratio of about 7.4 to 1. A trace amount (0.05%) of benzidine was found in the catholyte mixture by mass spectrometry.

EXAMPLE 2

A cell was constructed as in Example 1, except the cathode was an amalgamated copper cathode prepared by dipping the copper screen alternately in dilute nitric acid and elemental mercury. The current was maintained at 3.9 amperes [20 A/dm$^2$]. The cell voltage was monitored throughout the run between 2.1 and 2.8 volts. An overhead stirrer was employed. After electrolysis the catholyte mixture (381.6 g) contained 5.73% para-aminophenol and 0.23% aniline for a molar ratio of about 22 to 1.

EXAMPLE 3

A cell was constructed having a third compartment between the anode and cathode compartments to rigorously exclude oxygen from the catholyte. The third compartment was separated from each electrode compartment by a cation exchange membrane and contained a sulfuric acid solution. Argon gas was bubbled through the central third compartment during electrolysis to prevent any oxygen gas generated at the anode from transferring into the cathode compartment. The anolyte, catholyte and third compartment electrolyte were each carefully degassed before entry to the cell. The initial catholyte was similar to Example 1 and included 26.5 g of nitrobenzene. The electrolysis was conducted within a glove bag under an argon atmosphere. The cathode was amalgamated copper. The current was maintained at 3.9 amperes [20 A/dm$^2$], the cell voltage was monitored between 5.2 and 3.9 volts and 70,000 coulombs were passed through the cell. After electrolysis the catholyte mixture (378.7 g) contained 3.03% para-aminophenol and 1.16% aniline for a molar ratio of only about 2.2 to 1. However, further analysis by mass spectrometry found no azoxybenzene, azobenzene or para-benzidine within the catholyte mixture.

EXAMPLE 4

Another run was conducted under conditions designed to exclude oxygen from the catholyte. The cell was identical to Example 3 except the cathode compartment was equipped with a septum. The reactants were injected into the cell through the septum by means of a syringe. No glove bag was employed. The initial catholyte contained 28.78 g of nitrobenzene in the mixture. After electrolysis the catholyte mixture (247.9 g) contained 0.82% para-aminophenol and 0.07% aniline for a molar ratio of about 10.7 to 1. No azoxybenzene, azobenzene or para-benzidine were found in the mixture.

The following example illustrates by comparison the advantage of the surfactant in the present invention.

EXAMPLE 5

A cell was constructed and operated as in Example 1 except the surfactant (dimethyldodecylamine-N-oxide) was deleted. After electrolysis, the catholyte mixture contained 1.73% para-aminophenol and 1.30% aniline for a molar ratio of 1.1 to 1.

The data of Examples 1–5 demonstrate that para-aminophenol can be prepared with high selectivity by the electrolytic reduction of nitrobenzene in an acidic, aqueous reaction medium including a trialkylamine-N-oxide surfactant. Further, by carefully excluding free oxygen from the catholyte during the electrolytic reduction, the production of undesirable by products such as azoxybenzene and para-benzidine can be controlled.

Obviously, many modifications and variations of the present invention are possible in light of the above teachings. It is therefore to be understood that, within the scope of the appended claims, the invention may be practiced otherwise than as specifically described.

We claim:

1. In the method of preparing para-aminophenol by electrolytic reduction of nitrobenzene in an acidic, aqueous reaction medium, the improvement which comprises emulsifying the nitrobenzene reactant in the acidic, aqueous reaction medium with a trialkylamine-N-oxide surfactant and electrolyzing said emulsified reaction medium.

2. The method of claim 1 wherein the surfactant is a dimethylalkylamine-N-oxide.

3. The method of claim 2 wherein the surfactant is dimethyldodecylamine-N-oxide.

4. The method of claim 1 wherein the electrolytic reduction is conducted under essentially oxygen-free conditions.

5. The method of claim 3 wherein the electrolytic reduction is conducted under essentially oxygen-free conditions.

6. In the method of preparing para-aminophenol by electrolytic reduction of nitrobenzene in an acidic, aqueous reaction medium, the improvement which comprises emulsifying the nitrobenzene reactant in the acidic, aqueous reaction medium with a trialkylamine-N-oxide surfactant and electrolyzing said emulsified reaction medium in an electrolytic cell having an anolyte compartment with an anode therein, a catholyte compartment with a cathode therein and a cation exchange membrane separating the anolyte compartment and the catholyte compartment.

7. The method of claim 6 wherein the cathode is comprised of an amalgamated metal.

8. The method of claim 7 wherein the surfactant is a dimethylalkylamine-N-oxide.

9. The method of claim 8 wherein the surfactant is dimethyldodecylamine-N-oxide.

10. The method of claim 6 wherein the catholyte compartment is maintained under essentially oxygen-free conditions during the electrolytic reduction.

11. The method of claim 9 wherein the catholyte compartment is maintained under essentially oxygen-free conditions during the electrolytic reduction.

12. The method of claim 8 wherein the cathode comprises an amalgamated metal selected from the group consisting of amalgamated copper, amalgamated nickel, amalgamated zinc, and an amalgamated nickel-copper alloy.

13. The method of claim 11 wherein the cathode comprises an amalgamated metal selected from the group consisting of amalgamated copper, amalgamated nickel, amalgamated zinc, and an amalgamated nickel-copper alloy.

14. The method of claim 9 wherein the cathode is amalgamated copper.

15. The method of claim 14 wherein the catholyte compartment is maintained under essentially oxygen-free conditions during the electrolytic reduction.

16. The method of claim 15 wherein the electrolytic cell further includes a third compartment between said anolyte compartment and said catholyte compartment, said third compartment separated from each of said anolyte and catholyte compartments by a cation exchange membrane.

17. In the method of preparing para-aminophenol by electrolytic reduction of nitrobenzene in an acidic, aqueous reaction medium, the improvement which comprises emulsifying the acidic, aqueous reaction medium by addition of about 0.12 percent by weight dimethyldodecylamine-N-oxide as a surfactant, said reaction medium including from about 5 to 20 percent by weight of the nitrobenzene reactant on the basis of total weight of reaction medium, and the balance water and about 2 M sulfuric acid within said medium, and electrolyzing said emulsified reaction medium at a temperature of about 80° to 100° C. and a current density of about 15 to 25 $A/dm^2$ in an electrolytic cell having an anolyte compartment with an anode and anolyte therein, a catholyte compartment with an amalgamated copper cathode and the reaction medium therein and a cation exchange membrane separating the anolyte compartment and the catholyte compartment.

18. The method of claim 17 wherein the electrolytic cell further includes a third compartment between said anolyte compartment and said catholyte compartment, said third compartment separated from each of said anolyte and catholyte compartments by a cation exchange membrane.

19. The method of claim 17 wherein the catholyte compartment is maintained under essentially oxygen-free conditions during the electrolytic reduction.

20. The method of claim 18 wherein the catholyte compartment is maintained under essentially oxygen-free conditions during the electrolytic reduction.

* * * * *